US005597105A

United States Patent [19]

Keller

[11] Patent Number: 5,597,105

[45] Date of Patent: Jan. 28, 1997

[54] APPARATUS FOR BUFFERING A VARIABLE LENGTH LOOP OF STRIP MATERIAL

[75] Inventor: Guido Keller, Adlikon, Switzerland

[73] Assignee: Gretag Imaging AG, Regensdorf, Switzerland

[21] Appl. No.: 377,002

[22] Filed: Jan. 23, 1995

[30] Foreign Application Priority Data

Feb. 24, 1994 [DE] Germany ..... 94810118.3

[51] Int. Cl.[6] ..... B65H 20/24; G11B 15/56

[52] U.S. Cl. ..... 226/118; 242/418.1

[58] Field of Search ..... 226/113, 114, 226/118, 119, 45, 42, 190, 194; 242/417.3, 418.1

[56] References Cited

U.S. PATENT DOCUMENTS

| | | | |
|---|---|---|---|
| 2,008,618 | 7/1935 | Lefebvre | 242/417.3 |
| 2,435,298 | 2/1948 | Leuven | 226/194 X |
| 2,913,885 | 11/1959 | Debrie | 226/191 X |
| 3,123,317 | 3/1964 | Clark et al. | 242/417.3 |
| 3,727,820 | 4/1973 | Braun | 226/113 |
| 3,942,190 | 3/1976 | Detwiler | 226/113 X |
| 4,350,277 | 9/1982 | Anderson et al. | 226/190 |
| 4,544,253 | 10/1985 | Kummerl | 226/190 x |
| 5,050,812 | 9/1991 | Mueller | 226/119 X |
| 5,197,644 | 3/1993 | Gillett et al. | 226/118 |

FOREIGN PATENT DOCUMENTS

| | | |
|---|---|---|
| 2227995 | 6/1972 | Germany . |
| WO87-02019 | 4/1987 | WIPO . |

*Primary Examiner*—Daniel P. Stodola
*Assistant Examiner*—Emmanuel M. Marcelo
*Attorney, Agent, or Firm*—Burns Doane Swecker & Mathis, L.L.P.

[57] ABSTRACT

A loop buffer having an input and an output deflector roll and a loop roll flexibly mounted between them in a basically vertical position, with its height relative to the deflector rolls determining the loop length of the strip material to be transported. The loop roll is gravity tensioned via a relatively weak spring by a ballast body guided with free movement in a basically vertically direction. The loop roll also includes two or three parallel coaxial loop wheels of slightly different diameter, adapted to the thickness profile of the strip material, transverse to the longitudinal direction. By selecting a relatively weak spring, the loop roll can follow small but quick changes in the transport speed very easily and quickly, with the acceleration forces caused by tile low inert mass of the moving parts remaining very low. Larger drift movements of the loop roll because of speed differences of greater duration between the feeding and removal of the strip material have the effect of displacing the ballast body, the gravity tensioning of the loop roll and thus the tension exerted on the strip material always remaining constant.

15 Claims, 4 Drawing Sheets

81
8
83
9c
5a
5b
41
4
7
3
9b
85
35
33
32
31
42
6
45
43
9a
44
34
84
82
R

APPARATUS FOR BUFFERING A VARIABLE LENGTH LOOP OF STRIP MATERIAL

BACKGROUND OF INVENTION

The invention concerns a loop buffer with variable loop length for a conveyor for strip material. More particularly, the invention relates to a loop buffer for continuous strips of film material made up of individual sections. The loop buffer includes a deflector roll on each of input and output sides, powered if appropriate, and a loop roll flexibly mounted between them in a vertical direction, the height of which relative to the deflector rolls determines the loop length.

Loop buffers of this type are used in strip conveyors to decouple asynchronous conveyor speed at various stations in the conveyor system. One typical application is machines for processing photographic material, normally called printers, where the speeds of the various processing stages vary greatly. There are some sections where the strip material is advanced continuously in a substantially uniform manner, and other sections (e.g. the notching station and the exposure station) where the strip material is conveyed in larger or smaller steps.

Loop buffers of this general type hitherto disclosed have a relatively heavy loop roll, or one which is held down by a spring, with the spring extending over the whole travel of the loop roll. The loop roll is mounted on a weighted pivoting lever as disclosed in DE-A-22 27 995. The loop roll is weighted or spring-tensioned to ensure positive feeding of the strip material. In practice these loop buffers generate severe impacts and tension peaks in the strip material when the strip advance changes speed abruptly or drastically, as happens for example with intermittent advance, and these peaks and impacts constitute a serious danger of damage to the strip material, and/or lead to faults in the neighboring stations, and are therefore highly undesirable.

SUMMARY OF INVENTION

The purpose of the present invention is to thoroughly improve a loop buffer of this general type so that the strip material is fed correctly, and also so that unacceptable tensions in the strip material are reliably avoided even with abrupt changes in speed. This is to make the loop buffer particularly suitable for photographic film material made up of individual short strips, possibly with paper strips along the edge(s).

A loop buffer in the device disclosed which performs this function is characterized by the fact that the loop roll is gravity tensioned via a relatively weak spring by a ballast body with largely free vertical movement. The loop roll and its bearing elements which move together with it have in particular an extremely low inertial mass of, for example, only a few grams. By selecting a relatively weak spring, the loop roll can follow small but rapid changes in transport speed very easily and rapidly, and the acceleration forces remain very small caused by the low inertial mass. Larger drift movement in the loop roll because of more prolonged speed differences between the feed and removal of the strip material on the other hand cause the ballast body to shift, whilst the gravity tensioning of the loop roll and thus the tensile stress exerted on the strip material always remains constant. The loop roll constantly remains constantly in good contact with the strip material, and guides it correctly. The notorious jumping of the loop roll in the strip material loop in loop buffers known in the art and the resultant impacts against the strip material practically never occur even under extreme conditions.

With their specially adapted design, a loop roll of the loop buffer in the device disclosed comprises two or three parallel coaxial loop wheels of slightly different diameter, adapted to the thickness profile of the strip material across the longitudinal direction. This makes the loop buffer particularly suitable for products such as film material made up of individual short strips, and which may possibly also have paper strips along the edge. Such film material is common when processing repeat orders, and is well known for the special requirements it makes of conveyor systems since the stiffness of the strip material often changes over the length of the strip, and the film can often come unstuck from the paper strips along the edge.

BRIEF DESCRIPTION OF THE DRAWINGS

Other objects and advantages will become apparent from the following detailed description of preferred embodiments of the invention as described in conjunction with the accompanying drawings wherein like reference numerals are applied to like elements and wherein.

DETAILED DESCRIPTION OF THE PREFERRED EMBODIMENTS

Figure 1:
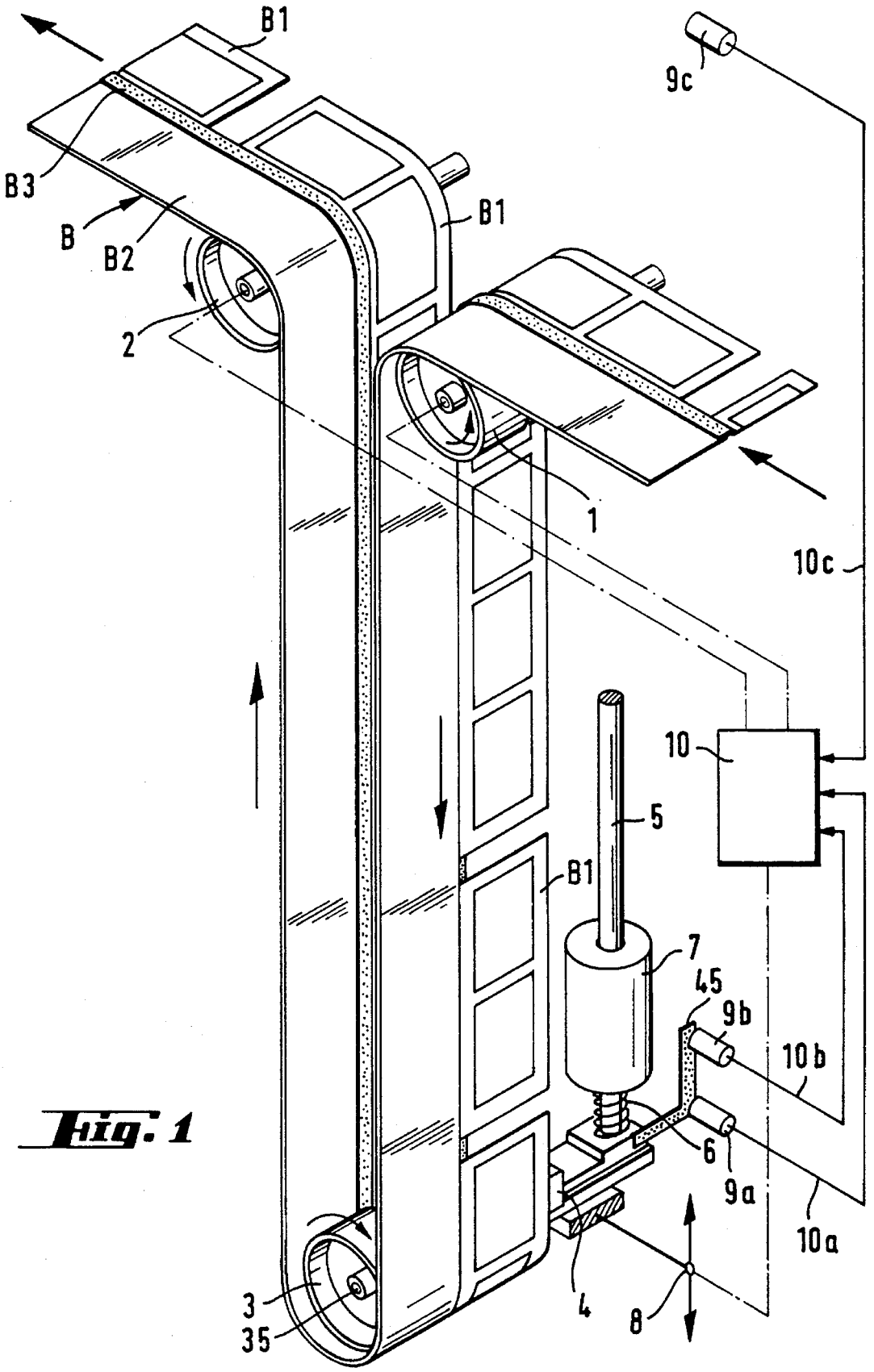
FIG. 1 shows a perspective schematic diagram of the elements of an exemplary loop buffer germane to the invention.

The principles of the construction and function of a loop buffer in accordance with the invention are shown most clearly in FIG. 1. The loop buffer includes principally two parallel deflector rolls 1 and 2, and a loop roll 3 running vertically up and down between the two deflector rolls. A length of strip material B comes from the first processing station (not shown). In this example, the photographic film strip comprises individual short strips B1 with a paper or plastic strip B2 applied to the sides, made up into a longer strip with a full length carrier strip B3. The photographic film strip runs over the three deflector loop rolls 1, 2 or 3 to a second processing station (also not shown). The strip material B is advanced asynchronously on the input and output side by independently powered advancing mechanisms, for example by the input and output side deflector roll 1 or 2 having a power drive. The deflector rolls 1 and 2 can of course also turn freely, and other provisions can be made for advancing the strip material.

The loop roll 3 is pivot mounted on a bearing slide 4 which in turn can be slid up and down on a vertical slide bar 5. The bearing slide 4 and thus indirectly loop roll 3 is gravity tensioned via a coil spring 6 by a ballast body 7, which also runs on the slide bar 5, moving freely up and down its length. A lift is also fitted, shown here only as the double arrow symbol 8, for moving the bearing slide 4 and thus the loop roll 3 into threading position (FIG. 4) above the level of the two deflector rolls 1 and 2.

There are three opto-electronic position sensors (light barriers) 9*a*, 9*b* and 9*c* mounted along the adjustment travel of the loop roll 3 or the bearing slide 4, which define vertical limit positions for the loop roll 3, and function together with a control 10 which sends control signals 10*a* and 10*b* to the feed devices (in this case deflector rolls 1 and 2) for transporting the strip material to and from the loop buffer, depending on the position of the loop roll 3, to keep the length of the loop in the loop buffer between the preset minimum and maximum values. Controlling the length of the loop in this way is known in existing loop buffers and therefore requires no further explanation. The position sensors also serve to control the movement of loop roll 3 into the threading position mentioned above and back into the normal operating position, as indicated symbolically by the signal line 10*c*. Since layouts and control circuits of this type are known in traditional loop buffers, no further explanation is needed in this case either.

To thread the strip material B, the loop roll 3 is lifted over the deflector rolls 1 and 2 using the lift 8, and the strip material is fed by means of the guide mechanism (not shown) through the gap between the two deflector rolls, until it is gripped by the feed mechanism on the output side. The loop roll 3 is then lowered by the lift 8 into operating position to form the buffer loop. If differences in speed now occur during operation between the strip advance on the input side and the output side, the length of the loop decreases or increases, followed by the loop roll 3, i.e. lifted or lowered. If the loop roll falls above or below the preset limit positions, the control 10 breaks or stops the input or output side strip advance momentarily as required, until the loop roll is again within the preset limit positions.

Brief, rapid changes in speed and the abrupt excursions of the loop roll 3 they cause are taken up by the relatively weak coil spring 6. The ballast body 7 remains practically stationary because of its inertia. Speed differences which last longer cause a drift movement of the loop roll 3 (within the preset limits) upwards or downwards, and the ballast body 7 follows the movement of the loop roll 3.

To ensure that the strip material B is positively fed, it is important that the loop roll 3 is always in close contact with the strip material loop. This means the loop roll must be subject to a minimum stress, resulting from the weight (mass) of the ballast body 7, which has to be determined by a few trials with the particular strip material B. For the above-mentioned photographic film material, as in processing repeat orders, a ballast mass of roughly 150 to 400 grams is generally suitable, the negligible mass of the loop roll 3 and parts attached to it and moving with it (bearing elements, etc.) not being taken into account, as explained below. In order to minimize the acceleration forces created by the abrupt change of speed, as arise in particular with intermittent advance, the mass of the loop roll 3 and parts that move with it (bearing block 4, etc.) must together be as small as possible. This can be achieved by a suitably simple design, and selecting special light construction materials such as plastic. For example total masses of roughly 50 to 70 grams have proved viable in practice for the above-mentioned application. The coil spring 6 linking the ballast body 7 to the loop roll 3 is also of significance. It must on the one hand be sufficiently gentle to absorb rapid excursions of the loop roll firmly and rapidly, and on the other hand must not be too weak to prevent "bottoming". In practice springs with a spring constant in the range roughly 0.2 to 0.6 N/cm have proved viable for the above-mentioned application.

Figure 2:
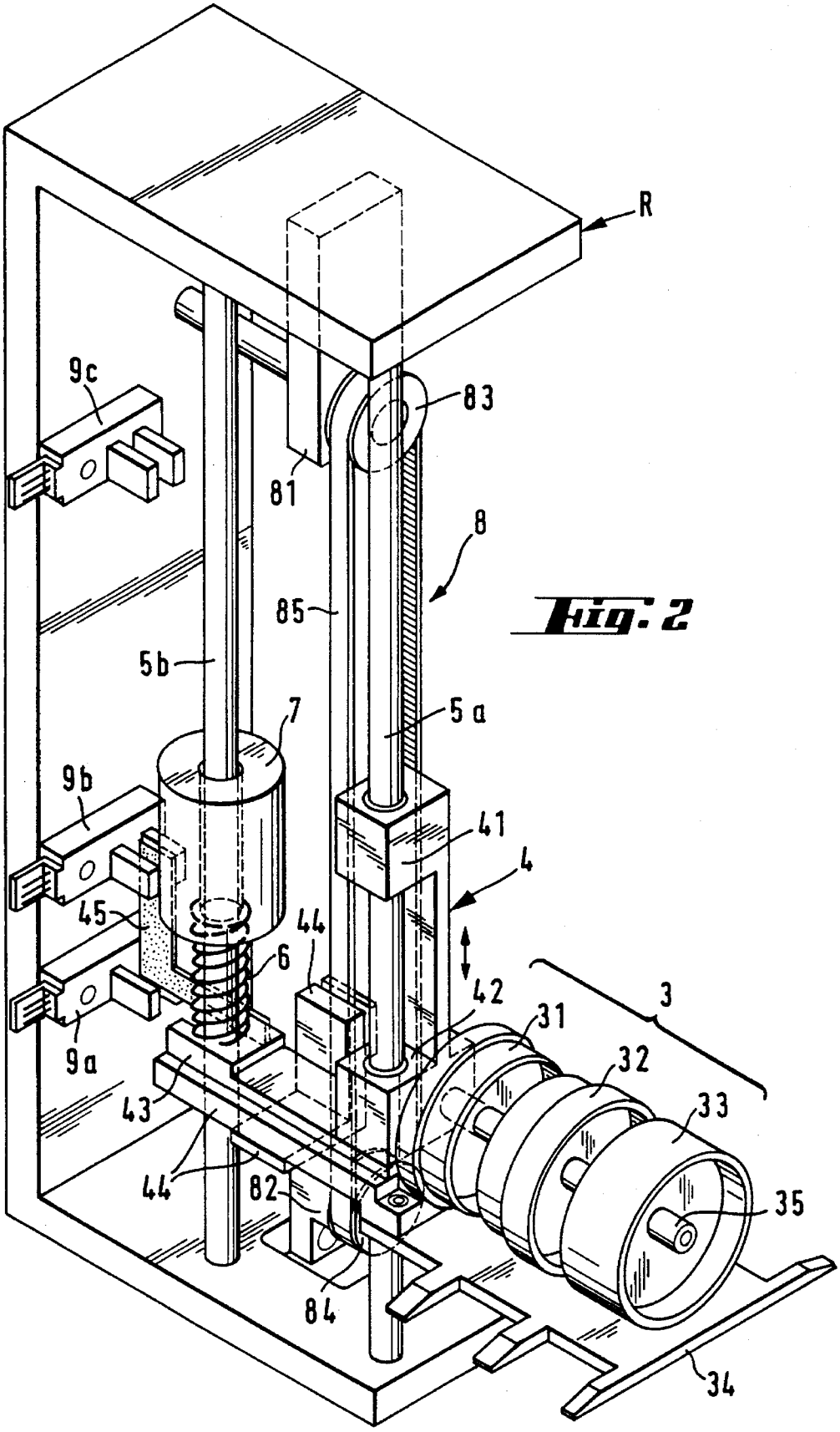
FIG. 2 show an angle view of the main elements of a practical embodiment of a loop buffer in accordance with the present invention.
Figure 3:
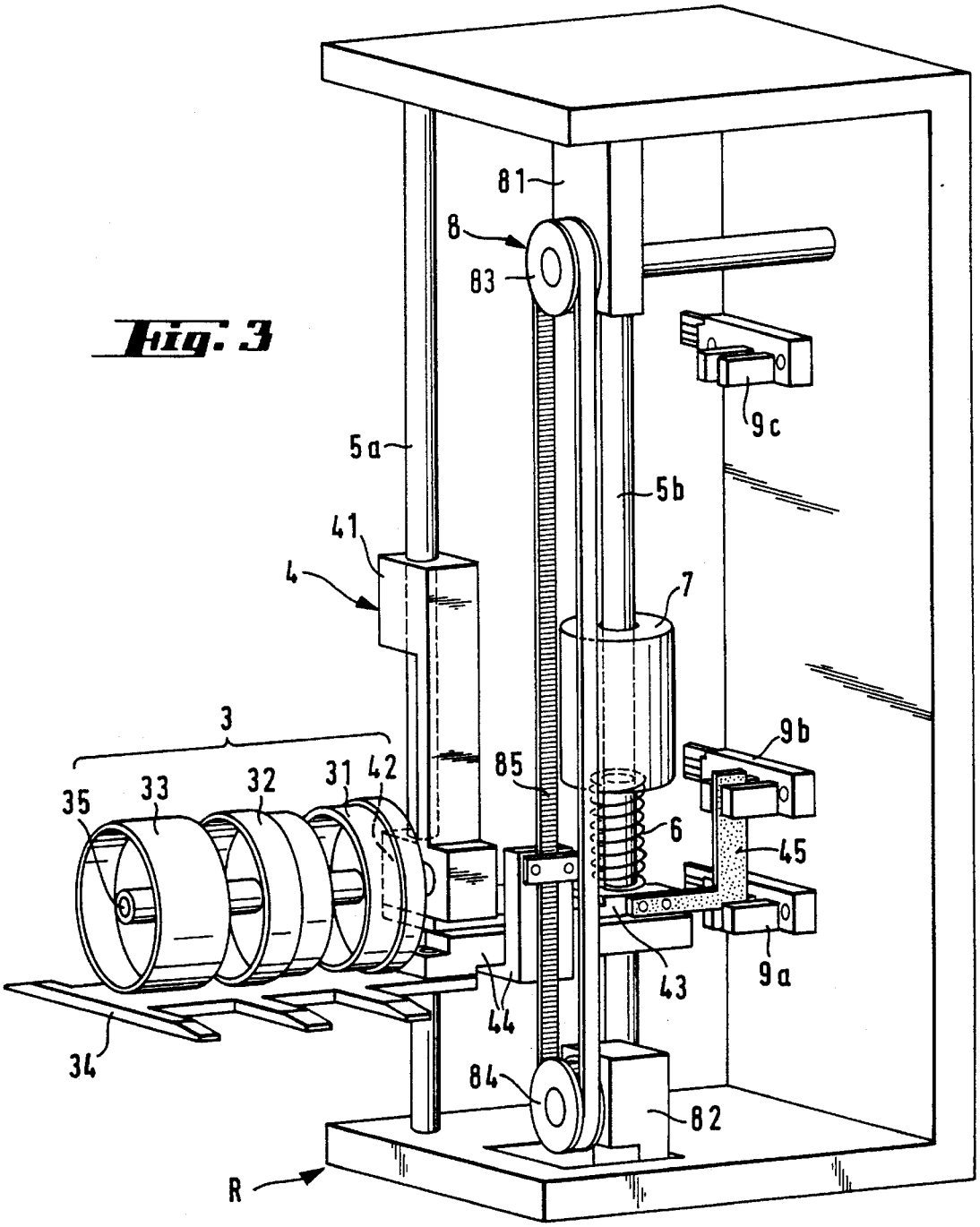
FIG. 3 shows a further angle view similar to FIG. 2, but facing in a different direction.
Figure 4:
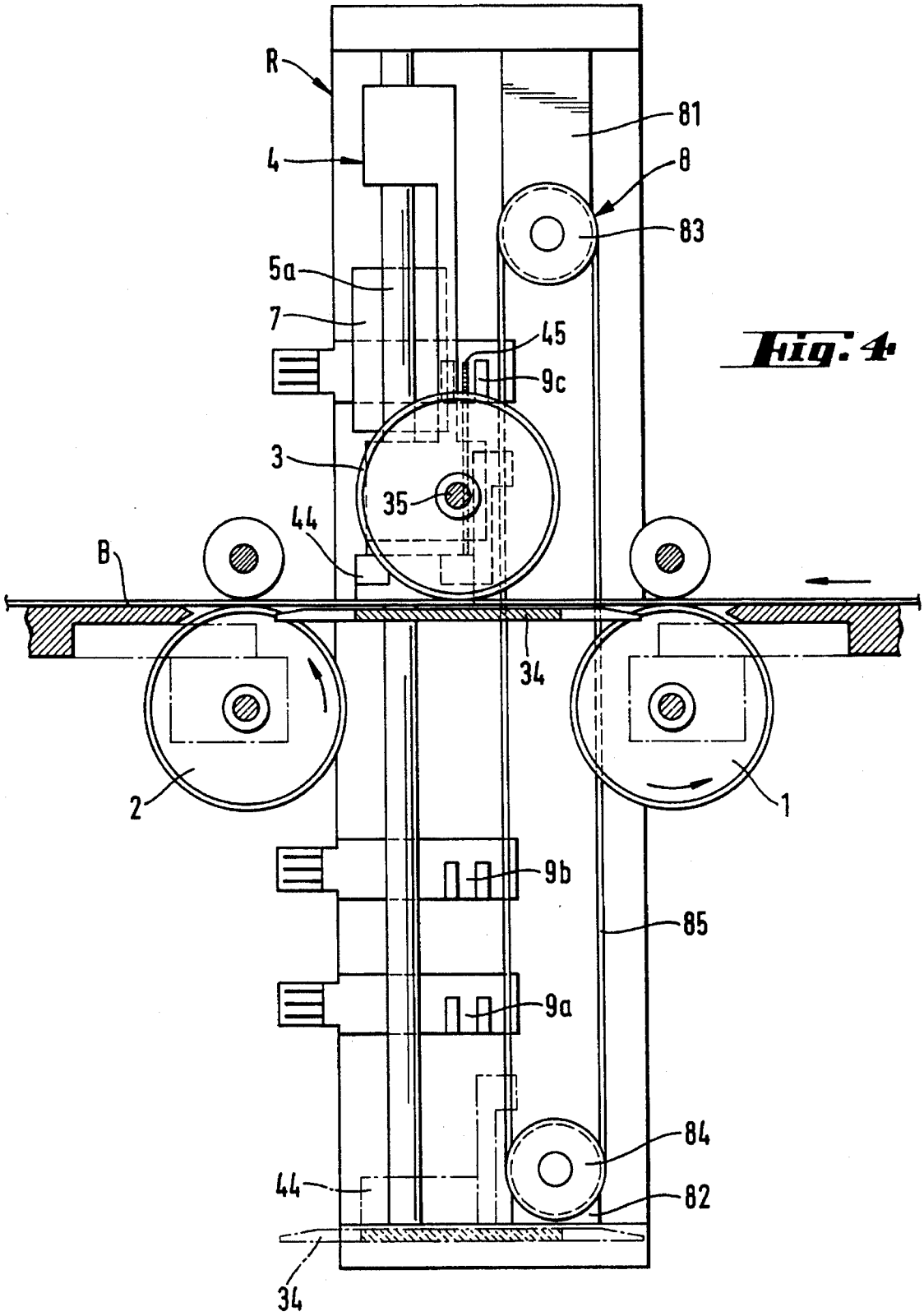
FIG. 4 shows a vertical section through elements of the practical embodiment of the loop buffer shown in FIG'S 2 and 3, with the loop buffer in the threading position.

FIGS. 2–4 show in detail an embodiment of the loop buffer in use, in an application particularly suited for use in photographic processing and finishing lines, with the elements which are not germane to the essence of the object of the invention omitted for the sake of clarity. The loop buffer is of course not usually a physically separate, independent unit (although this is in principle possible), but is usually integrated in a processing or finishing line for the strip material, or in the strip material conveyors of this line.

As shown in FIGS. 2–4, the part of the loop buffer shown comprises a frame arm on which all elements concerned with storing the loop roll, and its movement, are mounted, the whole forming one mechanical unit which can be used as a complete unit between the deflector rolls normally fitted in the processing line, as shown in FIG. 4. The deflector rolls can of course also be fitted to the frame R.

In the U-shaped frame R, two vertical slide bars 5*a* and 5*b* are rigidly fixed between the two horizontally mounted parallel rails. Two pulleys 83 and 84 are pivot-mounted in two bearing blocks 81 and 82, the upper pulley (83) being driven by a motor (not shown). A transport belt 85 runs over both pulleys 83 and 84, and both its leaders run parallel to the slide bars 5*a* and 5*b*, i.e. vertically. The two pulleys 83 and 84 and the transport belt 85, together with the drive motor (not shown) form the above-mentioned lift 8 for the vertical movement of the loop roll 3.

A basically L-shaped bearing slide 4 made up of several plastic parts slides easily on three bearing bushes 41, 42 and 43 on the two slide bars 5*a* and 5*b*, with two bearing bushes on the front slide bar 5*a*, and one on the rear slide bar 5*b*. The complete loop roll marked 3 is pivot mounted on the bearing slide 4. A further bearing slide 44 is mounted just below the above-mentioned bearing slide 4, and is fixed on the one leader of the transport belt 85. The bearing slide 44 is under bearing slide 4, so that bearing slide 4 can be moved upwards with the transport belt. The downward movement of bearing slide 4 is powered by gravity only.

Just under loop roll 3 on bearing slide 4 another flat guide piece 34 is fixed, bridging the gap between the two deflector rolls 1 and 2 in the threading position of loop roll 3 shown in FIG. 4.

The ballast body 7, which in this case is cylindrical, slides freely on the rear slide bar 5*b*. It is supported by the above-mentioned relatively weak coil spring 6 on the bearing slide 4, and thus indirectly applies its weight to the loop roll 3.

On the back wall of the frame R, three light barriers 9*a*, 9*b* and 9*c* are mounted in three different vertical positions, acting as position sensors for the vertical position of the loop roll 3 in the manner mentioned before. They work together with a fin 45 fixed to the bearing slide, which moves between the two rails of the light barriers.

The loop roll 3 includes 3 parallel loop wheels 31, 32 and 33 mounted on a common shaft 35. The two loop wheels 31 and 32 have slightly stepped diameters, the third loop wheel 33 is a simple cylindrical roller. The diameter of the individual loop wheels are matched to the transverse thickness profile of the strip material to be transported, providing suitable guiding. This is of importance particularly when the strip material is a "difficult" material, as is often the case in photographic laboratories, made up of individual strips of film, some with and some without information strips along the side, held together with a continuous carrier strip. It is preferable if the deflector rolls 1 and 2 are similarly shaped. This has the additional advantage that in the comb type design of guide element 34 shown, the distance between the two deflector rolls can be bridged better in the threading position.

It will be appreciated by those skilled in the art that the present invention can be embodied in other specific forms without departing from the spirit or essential character thereof. The presently disclosed embodiments are therefore considered in all respects to be illustrative and not restrictive. The scope of the invention is indicated by the appended claims rather than the foregoing description and all changes which come within the meaning and range of equivalents thereof are intended to be embraced therein.

What is claimed is:

1. A loop buffer for a conveyor of continuous strip material having loop length which is variable between a minimum value and a maximum value, comprising:

a deflector roll on each of an input side and an output side, respectively;

a loop roll movably mounted for displacement in a vertical direction between the deflector rolls at a height relative to the deflector rolls which determines the length of the loop;

a ballast body; and a spring which links said loop roll to said ballast body, said ballast body being guided freely movably in a vertical path between a first position in which the loop length has its minimum value and a second position in which the loop length has its maximum value,said loop roll being gravity tensioned by said ballast body via said spring.

2. The loop buffer according to claim 1, wherein the loop roll, and bearing elements moving together with it, have an inertial mass of at least a few grams.

3. The loop buffer according to claim 1, wherein the loop roll is movably mounted on a slide bar.

4. The loop buffer according to claim 3, wherein the ballast body is movably mounted on a slide bar.

5. The loop butter according to claim 4, wherein the loop roll moves above a level of the deflector rolls for threading the strip material.

6. The loop buffer according to claim 5, further comprising:

a motor drive for vertically adjusting the position of the loop roll.

7. The loop buffer according to claim 6, further comprising:

position sensors for sensing the vertical position of the loop roll.

8. The loop buffer according to claim 7, further comprising:

a control which functionally cooperates with the position sensors to produce control signals for feeding and removing the strip material when preset vertical limit positions are exceeded.

9. The loop buffer according to claim 8, wherein the loop roll further includes:

at least two parallel and coaxial loop wheels.

10. The loop buffer according to claim 9, wherein the loop wheels have stepped diameters, the diameters being adapted to a transverse thickness profile of the strip material.

11. The loop buffer according to claim 1, wherein the ballast body is movably mounted on a slide bar.

12. The loop buffer according to claim 1, wherein the loop roll moves above a level of the deflector rolls for threading the strip material.

13. The loop buffer according to claim 1, further comprising:

a motor drive for vertically adjusting the position of the loop roll.

14. The loop buffer according to claim 1, wherein the loop roll further includes:

at least two parallel and coaxial loop wheels.

15. The loop buffer according to claim 1, wherein said strip material is photographic film material made up of individual sections.

* * * * *